United States Patent [19]

Hagger

[11] 4,306,360

[45] Dec. 22, 1981

[54] RECEPTACLE FOR MOLDED MATERIAL

[76] Inventor: Leonard D. Hagger, 221 Boston Post Rd., Wayland, Mass. 01778

[21] Appl. No.: 114,660

[22] Filed: Jan. 23, 1980

[51] Int. Cl.[3] ..... A43C 15/00; A43B 5/00; A43B 23/28

[52] U.S. Cl. ..... 36/59 R; 36/134; 36/67 D

[58] Field of Search ..... 36/59 R, 59 A, 59 B, 36/59 C, 59 D, 67 R, 67 D, 134

[56] References Cited

U.S. PATENT DOCUMENTS 3,133,363 5/1964 Phillips ..... 36/67 D 3,327,412 6/1967 Wilmanns et al. ..... 36/67 D 3,597,864 8/1971 MacNeill ..... 36/67 D

*Primary Examiner*—Patrick D. Lawson

*Attorney, Agent, or Firm*—Bruce D. Sunstein

[57] ABSTRACT

A receptacle that can be incorporated into a molded body includes a metal receptacle and a case in which at least part of the metal receptacle is imbedded. The receptacle made in accordance with the present invention can be embodied in sport shoes, particularly golf shoes, to receive cleats. Such a receptacle is particularly suited to direct incorporation into relatively soft molded materials, such as polyurethane.

10 Claims, 7 Drawing Figures

RECEPTACLE FOR MOLDED MATERIAL

DESCRIPTION

1. Technical Field

The present invention relates to receptacles for incorporation into a molded body, particularly receptacles for cleats of the type commonly found attached to the soles of sport shoes, and particularly golf shoes.

2. Background Art

Metal receptacles for cleats are well-known in the prior art. Varous methods have been used to affix metal receptacles to soles of shoes to which cleats are to be attached. A common and effective prior art metal receptacle is shown in cross-section as item 12 in FIG. 1 below, as well as in cross-section in FIGS. 4 and 5 below.

Various techniques have been used to affix the metal receptacle to the sole of a shoe. In some instances, the receptacles are affixed to a thin metal or plastic plate, known as a sole plate, which in turn is incorporated into a sole. A heel plate is also used. A disadvantage of this approach is that different-sized sole and heel plates will be required to accomodate various sized shoes and the differing geometry of left and right sole-heel combinations. Typically men's golf shoes will require three or four sizes of sole plates, each with left and right versions, and well as two heel plates. Women's golf shoes will additionally require two or three sizes of sole plate, each in right and left figurations, as well as a heel plate.

In some instances, a metal receptacle may be incorporated directly into a molded sole, without use of a sole or heel plate. Many molded soles, however, are made of polyurethane or similar materials that may be too soft to hold firmly a metal receptacle of conventional design. The receptacles, under such circumstances, have been found to work loose and be unsatisfactory for mounting cleats. In working loose, such receptacles tend to destroy the sole in the vicinity of their mounting locations. Also, sole plates may tend to make the soles insufficient in flexibility and the sole plates themselves may tend to crack. Moreover, the relative rigidity of a sole plate, in relation particularly to a soft plastic sole, can cause the sole to crack and split.

DISCLOSURE OF INVENTION

Accordingly, it is an object of the present invention to provide a receptacle that can be incorporated directly into a molded body without use of supporting structure such as a sole plate or heel plate.

It is also an object of the present invention to provide a receptacle for direct incorporation into relatively soft molded materials.

It is a further object of the present invention to provide receptacles that can be incorporated into a molded sole in a wide range of geometric configurations.

It is a further object of the present invention to provide an inexpensive receptacle for incorporation into molded material, particularly soft flexible material.

These and other objects of the invention are achieved by providing a receptacle that includes (i) a metal receptacle of the type having a barrel that has one end open to permit access to the receptacle; and (ii) a relatively hard plastic case in which at least part of the barrel is embedded.

BRIEF DESCRIPTION OF THE DRAWINGS

These and other objects and features of the invention will be more readily understood by consideration of the following detailed description taken with the accompanying drawings, in which.

DESCRIPTION OF SPECIFIC EMBODIMENTS

Figure 1:
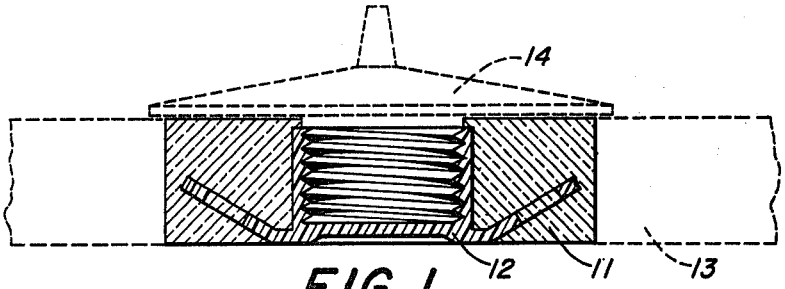
FIG. 1 is a cross-section of a preferred embodiment of the invention as actually employed in the sole of a golf shoe.

Referring to FIG. 1, there is shown in cross-section a preferred embodiment of the invention. The invention is placed in a molded sole 13. The invention comprises a metal receptacle 12 having features that will be discussed in more detail below, imbedded in a relatively hard plastic case 11. The plastic should be of a material that is chemically compatible with the material out of which the sole is molded. Noncompatible plastic may cause deterioration of the sole materials. A cleat 14 is screwed into the receptacle. The height of the metal receptacle 12 is approximately the same as the height of the top surface of the plastic case 11.

Figure 2:
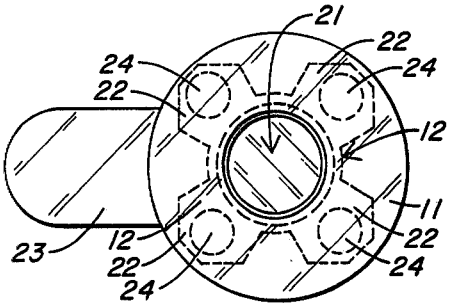
FIG. 2 is a top view of the embodiment shown in FIG. 1.
Figure 3:
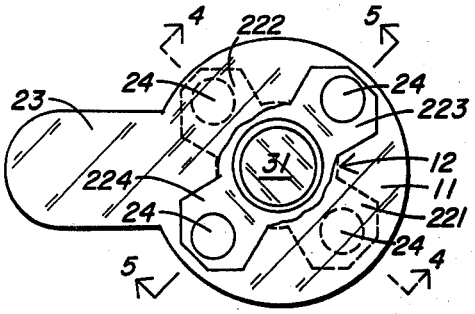
FIG. 3 is a bottom view of the embodiment shown in FIG. 2.

As can be seen from FIG. 2, which presents a top view of the embodiment, the case 11 is generally cylindrical in shape. There is a lateral projection 23 from this shape. I have found that the large mass of the case, particularly with the projection 23, tends to hold the receptacle more firmly in the molded sole than would be the case if a conventional metal receptacle were employed without the use of a case. Apparently the case distributes forces from the receptacle over a larger volume and area of the molded sole, thereby making the mechanical connection between sole and receptacle stronger than in the case of conventional receptacles. A similar result may be achieved with a case having an irregular shape and with a plurality of projections. Preferably the case is made of a material, such as nylon, that is relatively hard in relation to the material of which the sole is molded. Also shown in FIG. 2 is the metal receptacle 12. The dashed portion of the receptacle is beneath the top surface of the plastic case, and in fact located in the vicinity of the bottom surface of the case. The receptacle has four fins 22 that project from the base region of the receptacle. The fins could as well project from the middle region of the receptacle. Each fin contains a hole 24. The fin-hole combination assists in enabling the case 11 to grip firmly the metal receptacle. The top of the receptacle includes an entrance area 21. The threaded end of a cleat is inserted into the receptacle through the entrance 21 and threaded into the metal receptacle of the device. Referring now to FIG. 3, there is shown a bottom view of the receptacle shown in FIG. 2. Two of the fins 22 shown in FIG. 2 are parallel to the bottom surface of the plastic case; these two fins are designated as items 223 and 224 in FIG. 3. The other two fins go at an angle from the base of the metal receptacle in an upward direction. These latter two fins are designated as items 221 and 222. Because the fins are not all coplanar, the metal receptacle is more strongly imbedded in the case 11. The embedding may be further enhanced if some or all of the fins are twisted, as well as bent. Also shown in FIG. 3 are the holes 24 in the fins and the solid bottom 31 at the base of the receptacle.

Figure 4:
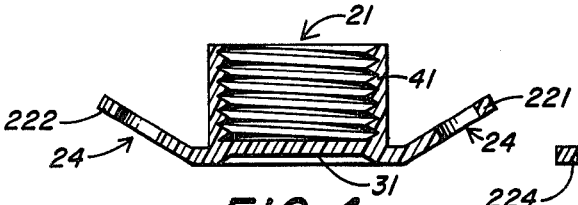
FIG. 4 is a cross-section of the metal receptacle used in the embodiment shown in FIGS. 1 through 3.
Figure 5:
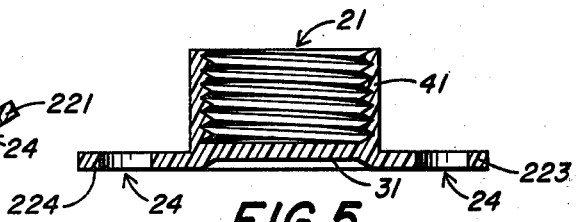
FIG. 5 is another cross-section of the metal receptacle shown in FIG. 4.

FIGS. 4 and 5 present views through vertical cross-sections of the metal receptacle 12 shown in FIGS. 1 through 3. FIG. 4 is taken through plane 4—4 and FIG. 5 is taken through plane 5—5 of FIG. 3. It will be seen that the metal receptacle comprises a barrel 41 that has been threaded, and has an opening 21 at the top. The bottom end 31 of the barrel is closed at the base of the metal receptacle. The fins 222 and 221 are angled up from the base and contain holes 24. The fins 224 and 223 are flat with respect to the base and also contain holes 24.

Figure 6:
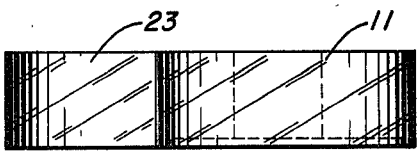
FIG. 6 is a side view of the embodiment shown in FIGS. 1 through 3.

FIG. 6 shows a side view of the embodiment shown in FIGS. 1 through 3. The projection 23 is at the same height as the main body of the case 11. It should be noted, however, that the projection need not be at the same height, the purpose being principally to distribute forces over a greater area of the sole than without such a projection.

Figure 7:
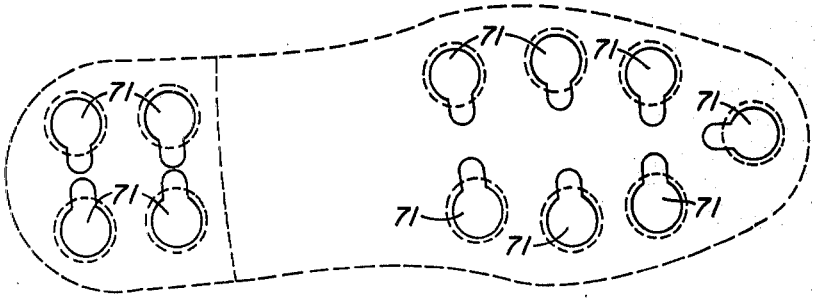
FIG. 7 is a view of a sole incorporating a plurality of receptacles in accordance with the present invention.

Finally, FIG. 7 shows a single piece molded sole and heel in which receptacles made in accordance with the invention are incorporated. Because the receptacles can be held in place by conventional means during the molding process, any geometric arrangement and quantity of the receptacles 71 are possible. Preferably, however, each receptacle is so arranged that its projection poses a minimum of interference with flexing of the sole.

Receptacles made in accordance with the present invention may be used in a variety of applications not necessarily related to the shoe industry. For example, some furniture components, such as arms of armchairs and sofas, may be molded of relatively soft plastic material. In order to attach such components to the furniture frame, receptacles that are made in accordance with the present invention may be incorporated into the molded component in a manner similar to that set forth above. In this fashion, the invention may afford a ready replacement for items such as "T-nuts", which are traditionally used for attaching such components.

Accordingly, while the invention has been described with particular reference to specific embodiments thereof in the interest of complete definiteness, it will be understood that it may be embodied in a variety of forms diverse from those shown and described without departing from the spirit and scope of the invention as defined by the following claims.

What is claimed is:

1. A receptacle for incorporation into a molded body, such receptacle comprising:

a metal receptacle of the type having a barrel, one end (hereinafter called the "entrance end") of the barrel being open to permit entrance to the receptacle generally along the longitudinal axis of the barrel; and a case in which at least part of the barrel is imbedded, whereby the case and thus the metal receptacle may be incorporated into the molded body.

2. A receptacle according to claim 1, in which the case is of a plastic material relatively hard in relation to the molded body and compatible therewith.

3. A receptacle according to claim 2, in which the metal receptacle further includes a fin protruding outwardly from the barrel, such fin being at least partially imbedded in the case.

4. A receptacle according to claim 2, in which the fin is attached to the barrel proximately to the end opposite to the entrance end.

5. A receptacle according to claim 2, in which the case is of thickness approximately equal to that of the length of the barrel along its longitudinal axis.

6. A receptacle according to claim 5, in which the case has a generally cylindrical shape, the height of the cylindrical shape being the thickness of the case.

7. A receptacle according to claim 6, in which the case also includes at least one projection from the cylindrical shape, in a direction radially with respect to the central vertical axis of the cylindrical shape.

8. A shoe sole molded predominantly from a material and comprising a plurality of receptacles, each such receptacle including:

a metal receptacle of the type having a barrel, one end (hereinafter called the "entrance end") of the barrel being open to permit entrance to the receptacle along the longitudinal axis of the barrel, and also having a fin protruding outwardly from the barrel; and a plastic case relatively hard in relation to the predominant material of which the sole is molded, and in which the barrel, and at least a portion of the fin, are at least partially imbedded, such case being of thickness approximately equal to that of the length of the barrel along its longitudinal axis.

9. A molded shoe sole according to claim 8, in which the case has a generally cylindrical shape, the height of the cylindrical shape being the thickness of the case.

10. A molded shoe sole according to claim 9, in which the case also includes a projection from the cylindrical shape, in a direction radially with respect to the central vertical axis of the cylindrical shape.

* * * * *